US007448427B2

(12) United States Patent
Ishii et al.

(10) Patent No.: US 7,448,427 B2
(45) **Date of Patent: *Nov. 11, 2008**

(54) FINE PARTICLE GENERATING APPARATUS, CASTING APPARATUS AND CASTING METHOD

(75) Inventors: Hiroshi Ishii, Utsunomiya (JP); Toshihide Sunada, Utsunomiya (JP); Yukihiro Mukaida, Utsunomiya (JP); Tomonori Sakai, Utsunomiya (JP); Yasushi Iseda, Minaminasu (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/589,190

(22) Filed: Oct. 30, 2006

(65) Prior Publication Data

US 2007/0039708 A1 Feb. 22, 2007

Related U.S. Application Data

(63) Continuation of application No. 10/501,898, filed on Jul. 20, 2004, now Pat. No. 7,143,806.

(51) Int. Cl.
*B22D 27/00* (2006.01)

(52) U.S. Cl. ..... 164/56.1; 164/57.1; 164/337

(58) Field of Classification Search ..... 164/337, 164/154.1, 150.1, 56.1, 55.1, 67.1, 57.1
See application file for complete search history.

(56) References Cited

U.S. PATENT DOCUMENTS

| | | | | |
|---|---|---|---|---|
| 2,487,474 | A * | 11/1949 | Porter | 423/409 |
| 3,619,173 | A | 11/1971 | Parlee et al. | |
| 4,273,315 | A | 6/1981 | Tinnes | |
| 4,424,853 | A | 1/1984 | Khandros et al. | |
| 4,545,975 | A | 10/1985 | Kobayashi et al. | |
| 6,179,897 | B1 | 1/2001 | Kunnmann et al. | |
| 6,359,267 | B1 | 3/2002 | Wilcox et al. | |
| 6,722,417 | B2 * | 4/2004 | Ban et al. | 164/56.1 |
| 6,745,816 | B2 | 6/2004 | Ban et al. | |
| 7,143,806 | B2 * | 12/2006 | Ishii et al. | 164/337 |

FOREIGN PATENT DOCUMENTS

| | | | |
|---|---|---|---|
| JP | 2000-280063 | A | 10/2000 |
| JP | 2001-321916 | A | 11/2001 |
| JP | 2001-321918 | A | 11/2001 |
| JP | 2001-321919 | A | 11/2001 |
| JP | 2001-321920 | A | 11/2001 |
| JP | 2001-321921 | A | 11/2001 |
| JP | 2001-353567 | A | 12/2001 |
| JP | 2002-28770 | A | 1/2002 |

* cited by examiner

*Primary Examiner*—Kevin P Kerns
(74) *Attorney, Agent, or Firm*—Birch, Stewart, Kolasch & Birch, LLP

(57) ABSTRACT

A fine metal particle producing mechanism has a metal holder for housing a body of magnesium, a tube for supplying an argon gas to the body of magnesium, an argon gas flow rate controller for controlling a rate at which the argon gas is supplied to the tube, and an argon gas heating controller for heating the argon gas supplied to the tube to a predetermined temperature.

13 Claims, 11 Drawing Sheets

FINE PARTICLE GENERATING APPARATUS, CASTING APPARATUS AND CASTING METHOD

The present application is a continuation of U.S. patent application Ser. No. 10/501,898, filed on Jul. 20, 2004, now U.S. Pat. No. 7,143.806.

TECHNICAL FIELD

The present invention relates to a fine particle producing apparatus for supplying a heated gas to a powder of metal or an elongate piece of metal to produce fine particles, a casting apparatus, and a casting method.

BACKGROUND ART

Various aluminum parts are cast by pouring molten aluminum or molten aluminum alloy (hereinafter referred to simply as "aluminum") into cavities in casting molds.

In the process of casting aluminum parts, an oxide film tends to be formed on the surface of molten aluminum that is poured into the mold cavities. The oxide film thus formed increases the surface tension of the molten aluminum and lowers the flowability of the molten aluminum, causing a variety of casting defects.

There have been known techniques for preventing the above shortcomings as disclosed in Japanese laid-open patent publications Nos. 2001-321916, 2001-321919, and 2001-321920, for example. Specifically, as shown in FIG. 10 of the accompanying drawings, a mold 1 has a cavity 1*a* for receiving molten aluminum 3 poured from a molten metal tank 2 through a hole 4 in the mold 1. The cavity 1*a* in the mold 1 is connected to a nitrogen gas container 6 by a pipe 5*a*, and also connected to a vacuum generating device (not shown) by a reduced-pressure pipe 5*b* (see Japanese laid-open patent publication No. 2001-321919).

An argon gas container 7 is connected to a heating furnace (metal gas generating device) 9 by a pipe 8. The argon gas container 7 is also connected by a pipe 10 to a tank 11 containing a magnesium powder, which is connected to the pipe 8 by a pipe 12.

The heating furnace 9 has an interior space that can be heated to a predetermined temperature by a heater 13. The heating furnace 9 communicates with the cavity 1*a* through a pipe 14 and a pipe 15. The heating furnace 9 incorporates therein a restricting means (not shown) for preventing magnesium from being delivered in a powder form into the pipe 14.

The system shown in FIG. 10 operates as follows: A nitrogen gas is introduced from the nitrogen gas container 6 through the pipe 5 into the cavity 1*a* in the mold 1, purging air from the cavity 1*a*. Therefore, a substantially oxygen-free atmosphere is developed in the cavity 1*a*. An argon gas is introduced from the argon gas container 7 through the pipe 8 into the heating furnace 9, from which oxygen is removed.

Then, an argon gas is introduced from the argon gas container 7 through the pipe 10 into the tank 11, delivering the magnesium powder from the tank 11 through the pipes 12, 8 into the heating furnace 9. The interior of the heating furnace 9 has been heated by the heater 13 to a temperature equal to or higher than the temperature at which a magnesium powder sublimes. Therefore, the magnesium powder supplied to the heating furnace 9 sublimes into a magnesium gas, which is introduced through the pipes 14, 15 into the cavity 1*a*. The cavity 1*a* is also supplied with the nitrogen gas from the nitrogen gas container 6, as described above.

In the cavity 1*a*, the magnesium gas and the nitrogen gas react with each other, generating magnesium nitride ($Mg_3N_2$). The magnesium nitride is precipitated as a powder on the inner wall surface of the cavity 1*a*. Preferably, the pressure in the cavity 1*a* is lowered by the vacuum generating device (not shown) to attract the magnesium nitride to the inner wall surface of the cavity 1*a*.

Then, the molten aluminum 3 in the molten metal tank 2 is poured through the hole 4 into the cavity 1*a*. Since the magnesium nitride is a reducing substance (active substance), when the molten aluminum 3 is brought into contact with the magnesium nitride in the cavity 1*a*, oxygen is removed from the oxide film on the surface of the molten aluminum 3. Therefore, the surface of the molten aluminum 3 is reduced to pure aluminum.

The conventional system shown in FIG. 10 is disadvantageous in that the system is considerably large in overall size because it has the heating furnace 9 combined with the heater 13. Therefore, the amount of heat required to cause a reaction between the magnesium gas and the nitrogen gas is large. The pipe 14 for introducing the magnesium gas produced in the heating furnace 9 into the cavity 1*a* is relatively long. Furthermore, the pipes 5, 14, 15 are connected to the mold 1. For these reasons, when the mold 1 is to be replaced, many replacing steps are involved and the entire replacement process is complex. It is difficult to control the reaction of the magnesium powder in the heating furnace 9, and the substance (magnesium) produced by the reaction is deposited in the heating furnace 9.

The vacuum generating device (not shown) used to develop an oxygen-free environment in the cavity 1*a* also makes the overall system considerably large in size. In addition, the need for a sealing structure for hermetically sealing the cavity 1*a* makes the system complex.

Japanese laid-open patent publications Nos. 2001-321918 discloses a method of casting aluminum. Specifically, as shown in FIG. 11 of the accompanying drawings, a mold 1 has a cavity 1*a* for receiving molten aluminum 3*a* poured from a molten metal tank 2*a* through a hole 4*a* in the mold 1. The cavity 1*a* in the mold 1 is connected to a nitrogen gas container 6*a* by a pipe 5. An argon gas container 7*a* is connected to a heating furnace 9*a* by a pipe 8*a*.

The argon gas container 7*a* is also connected by a pipe 10*a* to a tank 16 containing a magnesium powder. The tank 16 is connected to a metered quantity storage unit 18 which is connected to the pipe 8*a*. The heating furnace 9*a* communicates with the cavity 1*a* through a pipe 14*a*. A pressure-reducing pump 19 is connected to the mold 1 for reducing the pressure in the cavity 1*a*.

Operation of the system shown in FIG. 11 will be described below. The interior of the heating furnace 9*a* is heated by the heater 13 to a temperature equal to or higher than the temperature at which a magnesium powder sublimes. Thereafter, an argon gas is introduced from the argon gas container 7*a* through the pipe 8*a* and the heating furnace 9*a* into the cavity 1*a* in the mold 1, purging air from the cavity 1*a*.

Then, an argon gas is introduced from the argon gas container 7*a* through the pipe 10*a* into the tank 16, delivering the magnesium powder from the tank 16 into the metered quantity storage unit 18. The metered quantity storage unit 18 then supplies a metered amount of magnesium powder through the pipe 8*a* into the heating furnace 9*a*. The magnesium powder delivered into the heating furnace 9*a* sublimes into a magnesium gas, which is carried by the argon gas into the cavity 1*a*.

At this time, the pressure-reducing pump 19 is actuated to replace the existing gas in the cavity 1*a* with the magnesium gas and the argon gas, so that the magnesium gas is diffused in the cavity 1*a*. Then, a nitrogen gas is introduced from the nitrogen gas container 6*a* through the pipe 5 into the cavity 1*a*. In the cavity 1*a*, the magnesium gas and the nitrogen gas react with each other, generating magnesium nitride ($Mg_3N_2$). The magnesium nitride is precipitated as a powder on the inner wall surface of the cavity 1*a*.

Then, the molten aluminum 3*a* in the molten metal tank 2*a* is poured through the hole 4*a* into the cavity 1*a*. Since the magnesium nitride is a reducing substance, when the molten aluminum 3*a* is brought into contact with the magnesium nitride in the cavity 1*a*, oxygen is removed from the oxide film on the surface of the molten aluminum 3*a*. Therefore, the surface of the molten aluminum 3*a* is reduced to pure aluminum.

The conventional system shown in FIG. 11 is problematic in that the system is considerably large in overall size because it has the heating furnace 9*a*. In addition, it is difficult to control the reaction between the magnesium gas and the nitrogen gas in the cavity 1*a*, with the result that the amount of magnesium nitride produced in the cavity 1*a* is not sufficient, for example.

DISCLOSURE OF THE INVENTION

It is a general object of the present invention to provide a fine particle producing apparatus which can effectively be reduced in overall size and which is capable of reliably producing desired fine particles of metal.

A major object of the present invention is to provide a fine particle producing apparatus which can effectively be reduced in overall size and which is capable of reliably producing desired fine particles of magnesium nitride.

Another major object of the present invention is to provide a casting apparatus which can effectively be reduced in overall size, which can efficiently perform a desired casting process, which allows a mold to be replaced easily.

Still another major object of the present invention is to provide a casting method which is effective in developing a low-oxygen environment in a mold cavity through a simple process and which can efficiently perform a good casting process.

According to an aspect of the present invention, a powdery or elongate (filamentary or web-shaped) body of metal is housed in a metal holder with a porous member combined therewith, and a tube for supplying a gas to the body of metal through the porous member is mounted on the metal holder. The gas is supplied to the tube at a rate controlled by a gas flow rate controller, and the gas is supplied to the body of metal while it is being heated to a predetermined temperature by a gas heating controller connected to the tube.

Since the body of metal held by the metal holder is controlled at the predetermined rate and the predetermined temperature, it is possible to produce desired fine metal particles from the body of metal. A fine particle producing apparatus according to the present invention can effectively be reduced in size and simplified as it does not require a relatively large heating furnace. Furthermore, the reaction to produce the fine metal particles can be controlled easily.

If the body of metal comprises magnesium and the gas comprises a nitrogen gas (a reactive gas), then fine particles of magnesium nitride ($Mg_3N_2$) are produced. The fine particles of magnesium nitride are preferentially bonded to oxygen in a mold cavity, effectively preventing molten aluminum used for aluminum casting from being oxidized in the mold cavity. As a consequence, the molten aluminum is kept well flowable in the mold cavity, and hence can well be cast smoothly to shape.

If the body of metal comprises magnesium and the gas comprises an argon gas (an inactive gas), then fine particles of magnesium are produced. The fine particles of magnesium are oxidizable more easily than aluminum, and can effectively prevent molten aluminum used for aluminum casting from being oxidized in the mold cavity. Accordingly, when the molten aluminum is used, it can reliably be cast to shape.

According to another aspect of the present invention, a powdery or elongate body of magnesium is housed in a metal holder with a porous member combined therewith, and a tube for supplying an inactive gas to the body of magnesium through the porous member is mounted on the metal holder. The inactive gas is supplied to the tube at a rate controlled by a gas flow rate controller, and the inactive gas is supplied to the body of magnesium while it is being heated to a predetermined temperature by a gas heating controller connected to the tube.

Since the body of magnesium held by the metal holder is controlled at the predetermined rate and the predetermined temperature, it is possible to produce a desired magnesium gas and/or fine particles of magnesium from the body of magnesium.

The magnesium gas and/or the fine particles of magnesium are supplied to a reaction unit on which the metal holder is mounted. The reaction unit is supplied with a nitrogen gas heated to a predetermined temperature. In the reaction unit, therefore, the magnesium gas and/or the fine particles of magnesium and the nitrogen gas react with each other, producing fine particles of magnesium nitride.

Therefore, the fine particle producing apparatus can effectively be reduced in size and simplified as it does not require a relatively large heating furnace. Furthermore, the reaction to produce the fine particles of magnesium nitride can be controlled easily. The fine particles of magnesium nitride which are reliably produced due to a reaction in the reaction unit are supplied to the cavity of a casting mold where the fine particles of magnesium nitride are preferentially bonded to oxygen in the cavity. Thus, molten aluminum used for aluminum casting is effectively prevented from being oxidized in the cavity. As a consequence, the molten aluminum is kept well flowable in the mold cavity, and hence can well be cast smoothly to shape.

According to still another aspect of the present invention, furthermore, a fine particle generating mechanism for introducing fine metal particles immediately after the fine metal particles are produced, directly into the mold cavity, and a reactive gas supply mechanism for supplying the mold cavity with a reactive gas for reacting with the fine metal particles to produce an active substance (also referred to as easily oxidizable substance) which is more active with respect to oxygen than the molten metal, are directly connected at different positions to the mold which supplies the molten metal to the mold cavity to produce a casting.

The fine metal particles immediately after they are produced are introduced from the fine particle generating mechanism into the mold cavity, and the reactive gas is supplied from the reactive gas supply mechanism to the mold cavity. In the mold cavity, the fine metal particles and the reactive gas react with each other to produce an active substance. When the molten metal is then poured into the mold cavity, the active substance is preferentially bonded to oxygen in the mold cavity, effectively preventing the surface of the molten metal from being oxidized. Consequently, the molten aluminum is kept well flowable in the mold cavity, and hence can well be cast smoothly to shape.

According to yet another aspect of the present invention, the reaction unit is directly connected to the mold, and the fine particle generating mechanism and the reactive gas supply mechanism are connected to the reaction unit.

The fine metal particles immediately after they are produced are introduced from the fine particle generating mechanism into the reaction unit, and the reactive gas is supplied from the reactive gas supply mechanism to the reaction unit. In the reaction unit, the fine metal particles and the reactive gas react with each other to produce an active substance. Then, the active substance is introduced from the reaction unit into the mold cavity. When the molten metal is then poured into the mold cavity, the active substance is preferentially bonded to oxygen in the mold cavity, effectively preventing the surface of the molten metal from being oxidized. Consequently, the molten aluminum is kept well flowable in the mold cavity, and hence can well be cast smoothly to shape.

According to yet still another aspect of the present invention, a heated gas is supplied to a metal which is more active with respect to oxygen than a molten metal to produce a feed material containing a metal gas and/or fine metal particles, and thereafter the feed material is supplied to the cavity of a casting mold. In the cavity, the feed material itself is oxidized to develop a low-oxygen environment, and the fine metal particles and/or fine oxide metal particles float in the cavity and/or are deposited on the inner wall surface of the cavity.

Therefore, in the cavity, the feed material is bonded to oxygen to develop a low-oxygen environment. No seal is required to seal the cavity hermetically. When the molten metal is poured into the cavity, even if oxygen flows with the molten metal into the cavity, the floating fine metal particles are bonded to the oxygen. Thus, the molten metal is effectively prevented from being oxidized, is kept well flowable in the cavity, and hence can well be cast smoothly to shape.

The fine metal particles and/or the fine oxide metal particles are deposited as a porous layer on the inner wall surface of the cavity. Consequently, the deposited fine particles have a heat insulating ability.

The above and other objects, features, and advantages of the present invention will become more apparent from the following description when taken in conjunction with the accompanying drawings in which preferred embodiments of the present invention are shown by way of illustrative example.

BEST MODE FOR CARRYING OUT THE INVENTION

Figure 1:
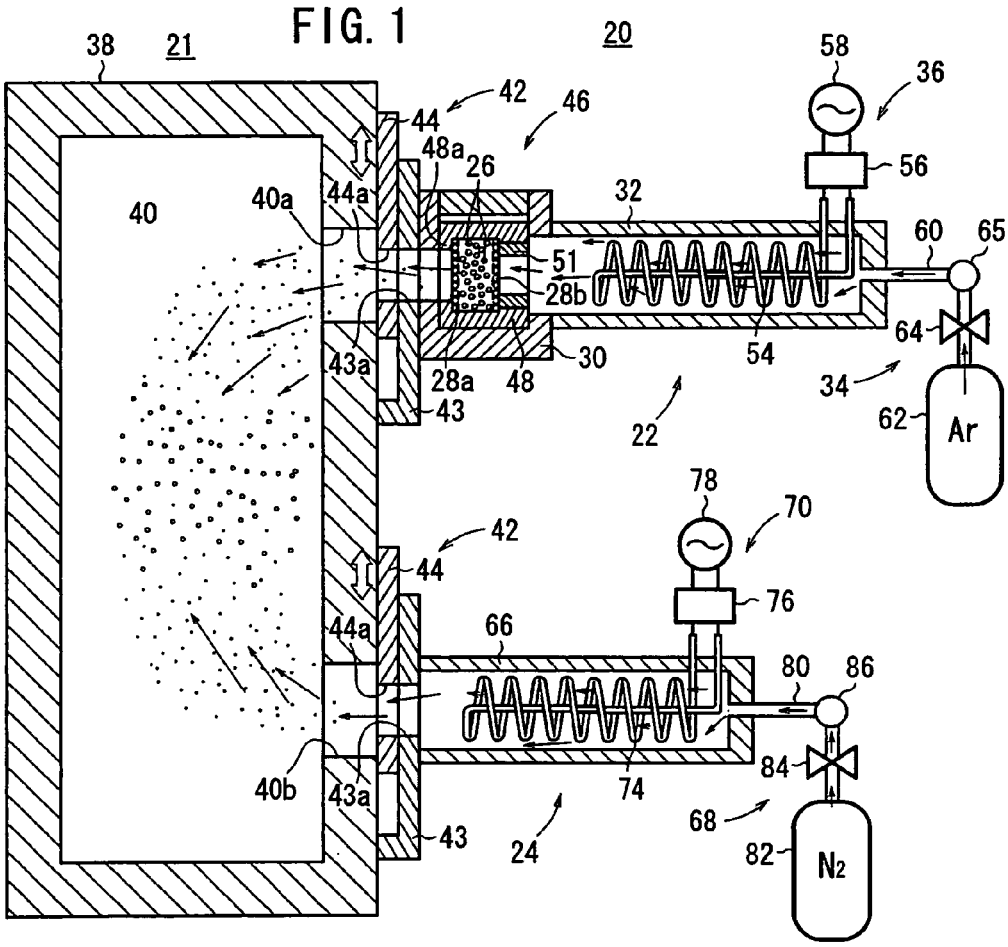
FIG. 1 is a cross-sectional view of a casting apparatus which incorporates a fine particle producing apparatus according to a first embodiment of the present invention.

FIG. 1 shows in cross section a casting apparatus 21 which incorporates a fine particle producing apparatus 20 according to a first embodiment of the present invention.

As shown in FIG. 1, the fine particle producing apparatus 20 generally has a fine metal particle producing mechanism 22 and a high-temperature gas producing mechanism (reactive gas supply mechanism) 24. The fine metal particle producing mechanism 22 comprises a metal holder 30 for holding a powder of metal, e.g., a magnesium powder 26, between a pair of spaced filters (porous members) 28*a*, 28*b* made of SUS (stainless steel), for example, a tube 32 mounted on the metal holder 30 for supplying an inactive gas such as an argon gas to the magnesium powder 26 through the filter 28*a*, an argon gas flow rate controller 34 for controlling the rate of an argon gas supplied to the tube 32, and an argon gas heating controller 36 connected to the tube 32 for heating the argon gas supplied to the magnesium powder 26 to a predetermined temperature.

The metal holder 30 is detachably connected to a casting mold 38 and communicates with a cavity 40 defined in the mold 38. The metal holder 30 is substantially in the form of a box with a through hole defined therein and is combined with a molten metal check mechanism 42, if necessary, on its side facing a hole 40*a* defined in a side wall of the mold 38.

Figure 2:
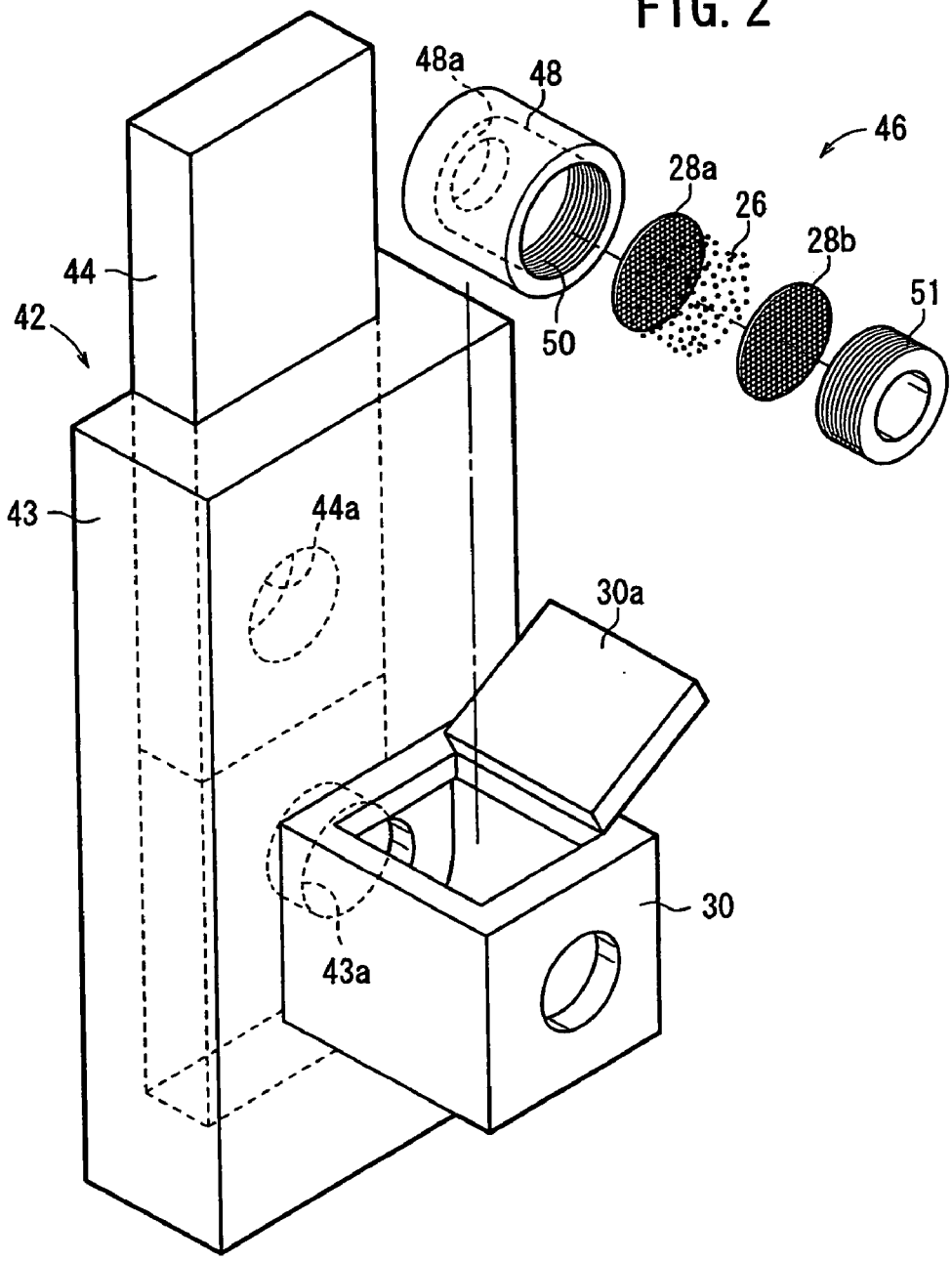
FIG. 2 is an exploded perspective view of the fine particle producing apparatus.

As shown in FIGS. 1 and 2, the molten metal check mechanism 42 has a stay 43 fixedly mounted on the mold 38 and a slide key 44 slidably supported by the stay 43. The stay 43 has a hole 43*a* defined therein coaxially with the hole 40*a*, and the slide key 44 has a hole 44*a* defined therein which can be selectively brought into and out of communication with the holes 40*a*, 43*a* upon sliding movement of the slide key 44. If the fine metal particle producing mechanism 22 is disposed in a location where there is no danger of molten metal flowing back, then the molten metal check mechanism 42 may be dispensed with.

A cartridge 46 is replaceably housed in the metal holder 30. As shown in FIG. 2, the cartridge 46 comprises a substantially cylindrical case 48 in which the filter 28*a* is inserted and seated on an open end bottom 48*a* of the case 48.

The magnesium powder 26 is sealed between the filters 28*a*, 28*b* in the case 48. The filters 28*a*, 28*b* have a mesh size selected to retain the magnesium powder 26 therebetween against leakage through the filters 28*a*, 28*b*. The case 48 has an internally threaded hole 50 defined in an open end thereof opposite to the open end bottom 48*a*, and a setscrew 51 is threaded in the internally threaded hole 50.

The metal holder 30 has an openable lid 30*a* for loading the cartridge 46 into and removing the cartridge 46 from the metal holder 30. The lid 30*a* may be swingably mounted on the metal holder 30 by a hinge (not shown) or may be slidably mounted on the metal holder 30 by a slidable guide (not shown).

The tube 32 has an end mounted on the metal holder 30 remotely from the mold 38. The tube 32 houses therein a heating element, e.g., an electric heating wire 54, electrically connected through a current/voltage controller 56 to a power supply 58 disposed outside the tube 32 (see FIG. 1). The electric heating wire 54, the current/voltage controller 56, and the power supply 58 jointly make up the argon gas heating controller 36.

The tube 32 has an opposite end connected to a pipe 60 which is connected to an argon gas container 62 of the argon gas flow rate controller 34. The argon gas container 62 can communicate with the tube 32 through an on/off valve 64 and a flow rate control valve 65.

The high-temperature gas producing mechanism 24 is similar in structure to the fine metal particle producing mechanism 22, and has a tube 66 detachably mounted at an end thereof on the mold 38, a nitrogen gas flow rate controller 68, and a nitrogen gas heating controller 70. The tube 66 is combined with another molten metal check mechanism 42 on its side facing a hole 40*b* defined in the side wall of the mold 38. The nitrogen gas heating controller 70 comprises an electric heating wire 74 disposed in the tube 66, a current/voltage controller 76 disposed outside the tube 66, and a power supply 78 disposed outside the tube 66 and electrically connected to the electric heating wire 74 through the current/voltage controller 76. The nitrogen gas flow rate controller 68 has a tube 80 communicating with the other end of the tube 66. The tube 80 is connected to a nitrogen gas container 82 by an on/off valve 84 and a flow rate control valve 86.

Operation of the casting apparatus 21 thus constructed will be described below in connection with the fine particle producing apparatus 20.

The metal holder 30 houses therein the magnesium powder 26 that is retained in the cartridge 46. Specifically, the magnesium powder 26 is inserted into the metal holder 30 as follows: Outside the metal holder 30, the case 48 of the cartridge 46 is placed with the bottom 48*a* down, and the filter 28*a* is inserted into the case 48 and seated on the bottom 48*a*. Then, the magnesium powder 26 is charged into the case 48 and placed on the filter 28*a*, after which the filter 28*b* is inserted into the case 48 over the magnesium powder 26. Then, the setscrew 51 is threaded into the internally threaded hole 50 in the case 48, thus sealing the magnesium powder 26 in the cartridge 46 (see FIG. 2).

The lid 30*a* is slid or swung open on the metal holder 30. After the cartridge 46 is inserted into the metal holder 30, the lid 30*a* is slid or swung into the closed position, thus loading the cartridge 46 in the metal holder 30.

The slide key 44 of the molten metal check mechanism 42 is slid to bring the hole 44*a* into communication with the hole 43*a* in the stay 43 and the hole 40*a* in the mold 38. Before the argon gas flow rate controller 34 is actuated, the argon gas heating controller 36 is actuated (see FIG. 1). In the argon gas heating controller 36, the current/voltage controller 56 controls a current/voltage to energize the electric heating wire 54, which is heated to increase the temperature in the tube 32. When the interior of the tube 32 reaches a predetermined temperature, the argon gas flow rate controller 34 is actuated.

In the argon gas flow rate controller 34, the argon gas supplied from the argon gas container 62 is introduced from the pipe 60 into the tube 32 at a flow rate controlled by the flow rate control valve 65. The argon gas as it flows through the tube 32 is heated to a predetermined temperature by the electric heating wire 54, and then is applied to the magnesium powder 26 through the filter 28*b* of the metal holder 30.

When the heated argon gas is applied to the magnesium powder 26, the magnesium powder 26 is evaporated into a magnesium gas, which is carried by the argon gas into the cavity 40 in the mold 38. At this time, the cavity 40 is being supplied with a nitrogen gas at a high temperature from the high-temperature gas producing mechanism 24.

The high-temperature gas producing mechanism 24 operates as follows: The nitrogen gas heating controller 70 is first actuated to heat the interior of the tube 66 to a predetermined temperature, and then the nitrogen gas flow rate controller 68 is actuated. The nitrogen gas supplied from the nitrogen gas container 82 to the tube 66 at a controlled rate is heated to a predetermined temperature, and then introduced from the tube 66 into the cavity 40.

In the cavity 40, part of the magnesium gas coalesces into fine particles of magnesium, and the magnesium gas which does not coalesce reacts with the high-temperature nitrogen gas ($3Mg+N_2 \rightarrow Mg_3N_2$), producing fine particles of magnesium nitride ($Mg_3N_2$). The fine particles of magnesium also react with the high-temperature nitrogen gas, producing fine particles of magnesium nitride.

Then, the slide keys 44 of both the molten metal check mechanisms 42 are slid to move the holes 44*a* out of communication with the holes 43*a* and the holes 40*a*, 40*b*. Then, molten aluminum (not shown) is poured into the cavity 40. Since the fine particles of magnesium nitride and the fine particles of magnesium have been present in the cavity 40, the fine particles of magnesium nitride are preferentially bonded to oxygen in the cavity 40, effectively preventing the molten aluminum from being oxidized in the cavity 40. As a consequence, the molten aluminum is kept well flowable in the cavity 40, and hence can well be cast to shape.

The fine particles of magnesium are oxidizable more easily than aluminum, i.e., an active substance. Therefore, the fine particles of magnesium can be bonded to oxygen in the cavity 40 to effectively prevent the molten aluminum from being oxidized.

According to the first embodiment, the metal holder 30 of the fine metal particle producing mechanism 22 is directly mounted on the mold 38, and the magnesium powder 26 held in the cartridge 46 is housed in the metal holder 30. The argon gas supplied at a rate controlled by the argon gas flow rate controller 34 has been introduced into the tube 32 which is kept at a predetermined temperature by the argon gas heating controller 36.

The magnesium powder 26 held by the metal holder 30 is thus heated by the argon gas supplied at the controlled rate and heated to the controlled temperature, reliably producing desired fine particles of magnesium (and a magnesium gas). The fine particles of magnesium generated in the metal holder 30 are directly supplied into the cavity 40 in the mold 38.

The casting apparatus 21 can effectively be reduced in size and simplified as it does not require a relatively large heating furnace and an elongate pipe for supplying fine metal particles. Furthermore, the reaction of the fine particles of magnesium (and the magnesium gas) can be controlled easily and economically with a low amount of heat.

The nitrogen gas which is a reactive gas supplied at the controlled rate and heated to the controlled temperature has been introduced into the cavity 40 by the high-temperature gas producing mechanism 24. Therefore, the magnesium gas and the nitrogen gas react well with each other in the cavity 40, generating fine particles of magnesium nitride.

The fine metal particle producing mechanism 22 and the high-temperature gas producing mechanism 24 are detachably mounted on the mold 38. Therefore, the number of replacing steps required to replace the mold 38 can effectively be reduced for efficient replacing operation. The casting apparatus 21 is highly versatile as it can easily be applied to various molds other than the mold 38.

Figure 3:
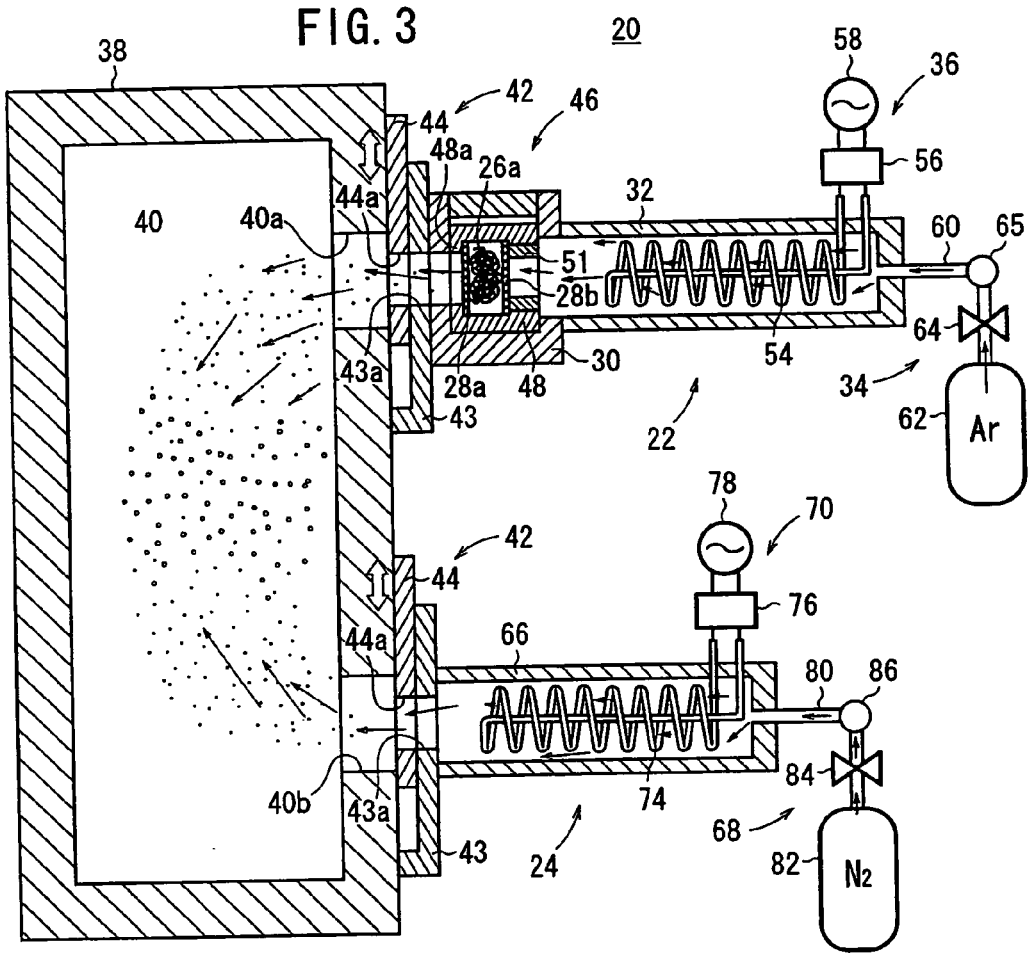
FIG. 3 is a cross-sectional view of the casting apparatus shown in FIG. 1 which is loaded with an elongate piece of magnesium.

In the first embodiment, the magnesium powder 26 is held in the cartridge 46 and removably housed in the metal holder 30. However, the magnesium powder 26 may directly be filled in the metal holder 30. Alternatively, as shown in FIG. 3, an elongate piece 26*a* of magnesium such as a filamentary or web-shaped piece of magnesium may be held in the cartridge 46 and housed in the metal holder 30.

Figure 4:
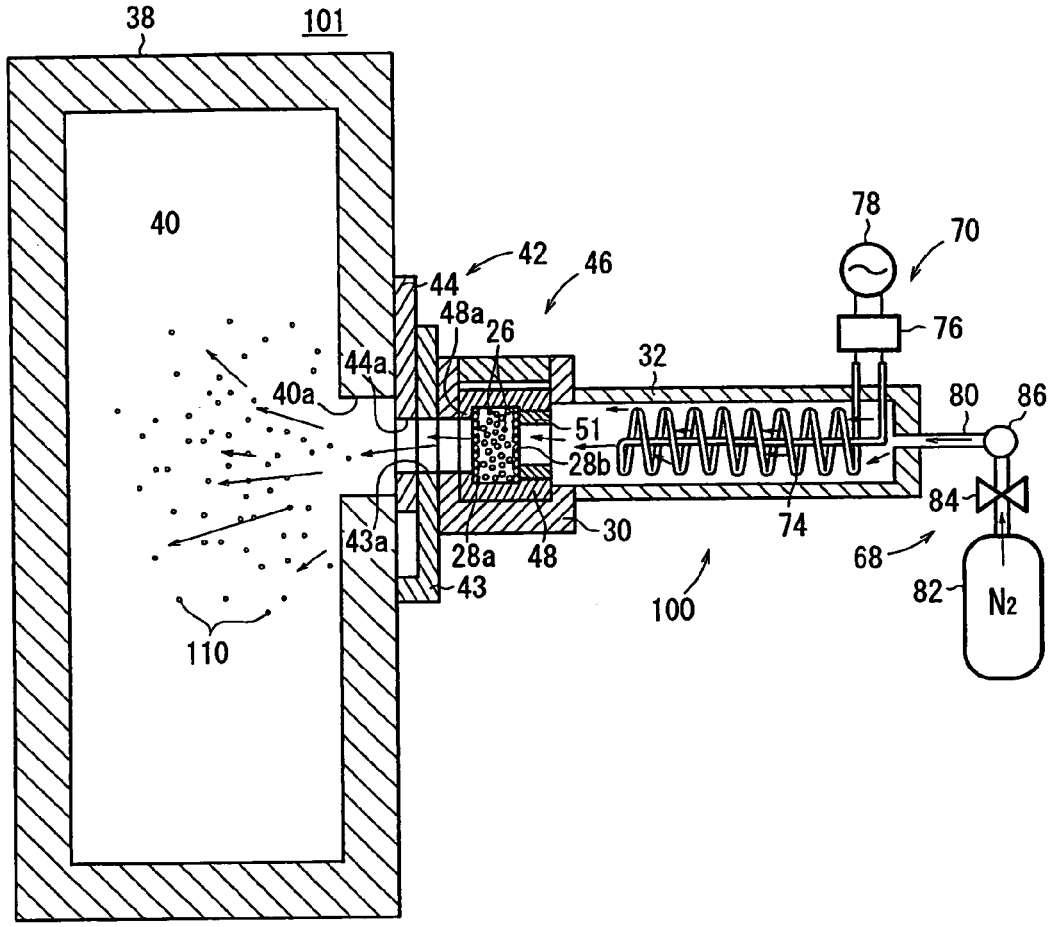
FIG. 4 is a cross-sectional view of a casting apparatus which incorporates a fine particle producing apparatus according to a second embodiment of the present invention.

FIG. 4 shows in cross section a casting apparatus 101 which incorporates a fine particle producing apparatus 100 according to a second embodiment of the present invention. Those parts of the casting apparatus 101 which are identical to those of the casting apparatus 21 according to the first embodiment are denoted by identical reference characters, and will not be described in detail below. Those parts of casting apparatus according to third through fifth embodiments, to be described later on, which are identical to those of the casting apparatus 21 according to the first embodiment are also denoted by identical reference characters, and will not be described in detail below.

As shown in FIG. 4, the casting apparatus 101 has a mold 38 and a fine particle producing apparatus (active substance producing mechanism) 100 detachably coupled directly to the mold 38. The fine particle producing apparatus 100 comprises a metal holder 30, a tube 32 mounted on the metal holder 30, a nitrogen gas flow rate controller 68 for supplying a nitrogen gas at a predetermined rate to the tube 32, and a nitrogen gas heating controller 70 combined with the tube 32 for heating the nitrogen gas to a predetermined temperature.

The casting apparatus 101 operates as follows: A magnesium powder 26 (or an elongate piece of magnesium) is housed in the metal holder 30. After the nitrogen gas heating controller 70 is actuated, the nitrogen gas flow rate controller 68 is actuated. Therefore, the interior of the tube 32 is first heated to a predetermined temperature, and the nitrogen gas supplied from the nitrogen gas container 82 at a controlled rate into the tube 32 is heated to a desired temperature.

Therefore, the magnesium powder 26 housed in the metal holder 30 is evaporated by the nitrogen gas, which has been supplied at the controlled rate and heated to desired temperature, introduced through the filter 28*b*. At least part of the magnesium gas and the high-temperature nitrogen gas react with each other ($3Mg+N_2 \rightarrow Mg_3N_2$), producing fine particles of magnesium nitride ($Mg_3N_2$). The remaining magnesium gas coalesces almost in its entirely into fine particles of magnesium. The fine particles of magnesium also reacts with the high-temperature nitrogen gas, generating fine particles of magnesium nitride.

Thus, a feed material 110 containing fine particles of magnesium nitride and fine particles of magnesium is introduced into the cavity 40, and preferentially bonded to oxygen in the cavity 40, effectively preventing the molten aluminum from being oxidized in the cavity 40. As a consequence, the molten aluminum is kept well flowable in the cavity 40, and hence can well be cast to shape.

The second embodiment as described above offers the same advantages as the first embodiment in that the casting apparatus 101 can effectively be reduced in size and simplified, and the reaction can easily be controlled to generate desired fine particles of magnesium nitride.

Figure 5:
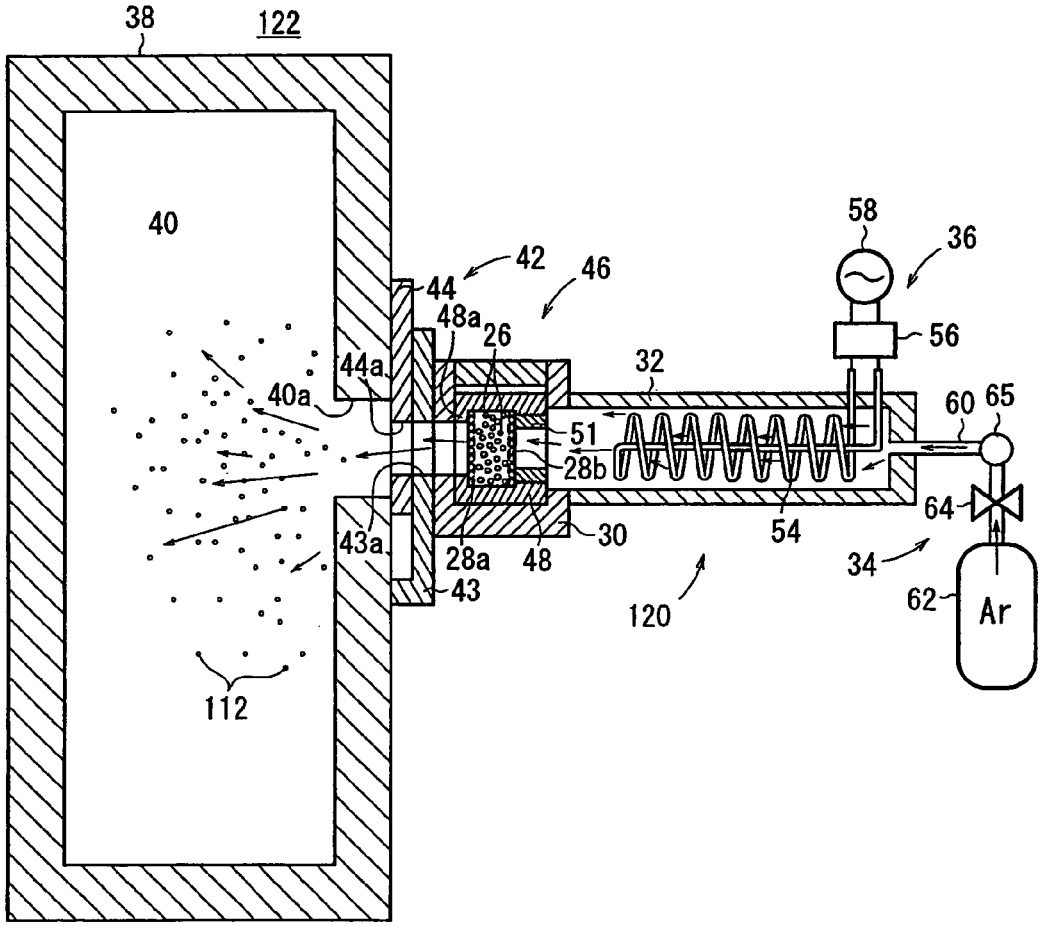
FIG. 5 is a cross-sectional view of a casting apparatus which incorporates a fine particle producing apparatus according to a third embodiment of the present invention.

FIG. 5 shows in cross section a casting apparatus 122 which incorporates a fine particle producing apparatus 120 according to a third embodiment of the present invention.

As shown in FIG. 5, the casting apparatus 122 has a mold 38 and a fine particle producing apparatus (active substance producing mechanism) 120 detachably coupled directly to the mold 38. The fine particle producing apparatus 120 comprises a metal holder 30, a tube 32 mounted on the metal holder 30, an argon gas flow rate controller 34 for supplying a nitrogen gas at a predetermined rate to the tube 32, and an argon gas heating controller 36 combined with the tube 32 for heating the argon gas to a predetermined temperature.

A metal housed in the metal holder 30 is a metal which is more active with respect to oxygen than a molten metal to be introduced into the mold 38. If the molten metal is molten aluminum, then the metal housed in the metal holder 30 comprises a magnesium powder 26.

The casting apparatus 122 operates as follows: While the interior of the tube 32 has been heated by the argon gas heating controller 36, an argon gas is supplied at a predetermined rate to the tube 32 through the argon gas flow rate controller 34.

In the argon gas flow rate controller 34, the argon gas supplied from the argon gas container 62 is introduced from the pipe 60 into the tube 32 at a flow rate controlled by the flow rate control valve 65. The argon gas as it flows through the tube 32 is heated to a predetermined temperature by the electric heating wire 54, and then is applied to the magnesium powder 26 through the filter 28*b* of the metal holder 30.

When the heated argon gas is applied to the magnesium powder 26, the magnesium powder 26 is evaporated into a magnesium gas, which is carried by the argon gas into the cavity 40 in the mold 38. In the cavity 40, there is a feed material 112 containing the magnesium gas and fine particles of magnesium which are produced by the coalescence of part of the magnesium gas.

Therefore, the feed material 112 itself is oxidized, developing a low-oxygen environment in the cavity 40. The fine particles of magnesium and fine particles of magnesium oxide float in the cavity 40 and are deposited on the inner wall surface of the cavity 40.

Then, the slide key 44 of the molten metal check mechanism 42 is slid to bring the hole 44*a* out of communication with the hole 43*a* in the stay 43 and the hole 40*a* in the mold 38. Then, molten aluminum (not shown) is poured into the cavity 40. The fine particles of magnesium (and the magnesium gas) have been present in the cavity 40, and the fine particles of magnesium are oxidizable more easily than aluminum. Therefore, the fine particles of magnesium are reliably bonded to oxygen in the cavity 40, effectively preventing the molten aluminum from being oxidized in the cavity 40.

In the third embodiment, since the feed material 112 including the magnesium gas and/or the fine particles of magnesium are bonded to oxygen in the cavity 40, a low-oxygen environment can easily be achieved in the cavity 40. Moreover, the casting apparatus 122 is simplified in overall arrangement as no seal structure is required to keep the cavity 40 hermetically sealed.

When the molten aluminum is poured into the cavity 40, even if oxygen flows with the molten aluminum into the cavity 40, the magnesium gas and/or the fine particles of magnesium which are floating in the cavity 40 is easily bonded to the oxygen. Thus, the molten aluminum is effectively prevented from being oxidized, is kept well flowable in the cavity 40, and hence can well be cast smoothly to shape.

The fine particles of magnesium and/or the fine particles of oxide magnesium are deposited as a porous layer on the inner wall surface of the cavity 40. Consequently, the deposited fine particles have a heat insulating ability. No special heat insulating material needs to be applied to the inner wall surface of the cavity 40, and hence the inner wall surface of the cavity 40 does not need to be coated with a heat insulation. Accordingly, the process of constructing the mold 38 is simplified.

Figure 6:
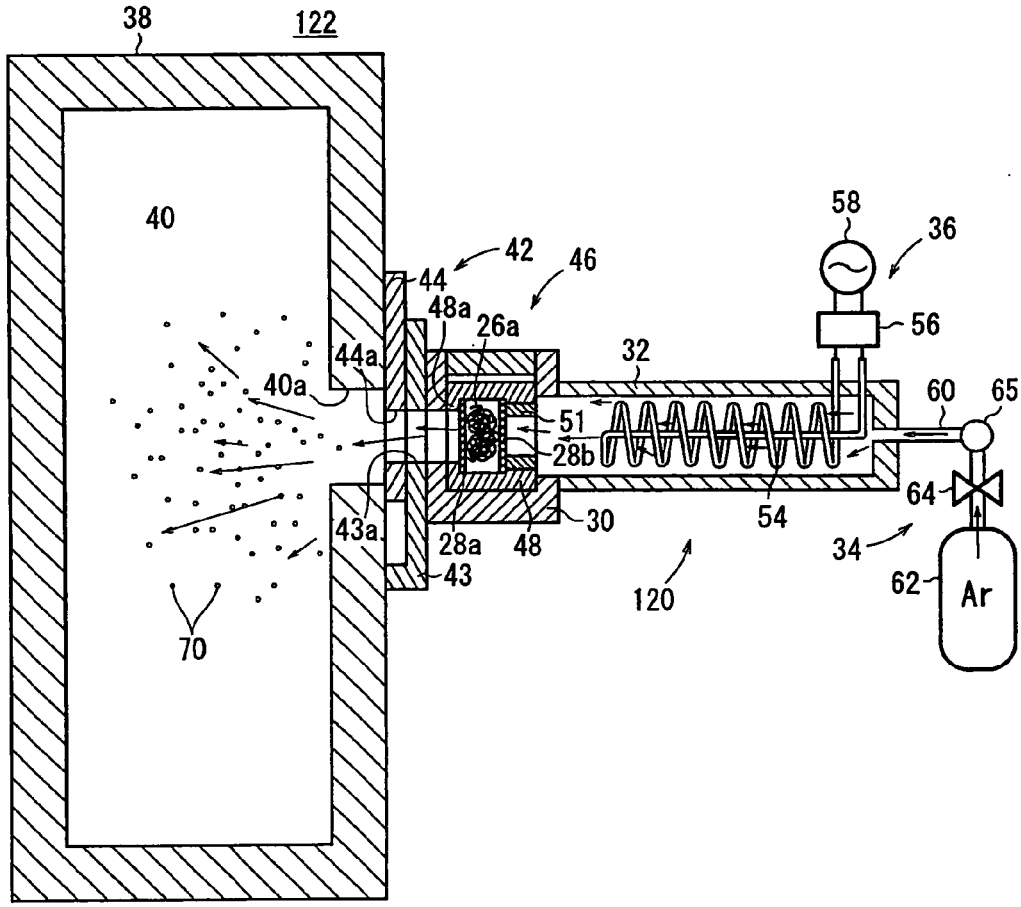
FIG. 6 is a cross-sectional view of the casting apparatus shown in FIG. 5 which is loaded with an elongate piece of magnesium.

In the third embodiment, the magnesium powder 26 is held in the cartridge 46 and removably housed in the metal holder 30. However, as shown in FIG. 6, an elongate piece 26*a* of magnesium such as a filamentary or web-shaped piece of magnesium may be held in the cartridge 46 and housed in the metal holder 30.

Figure 7:
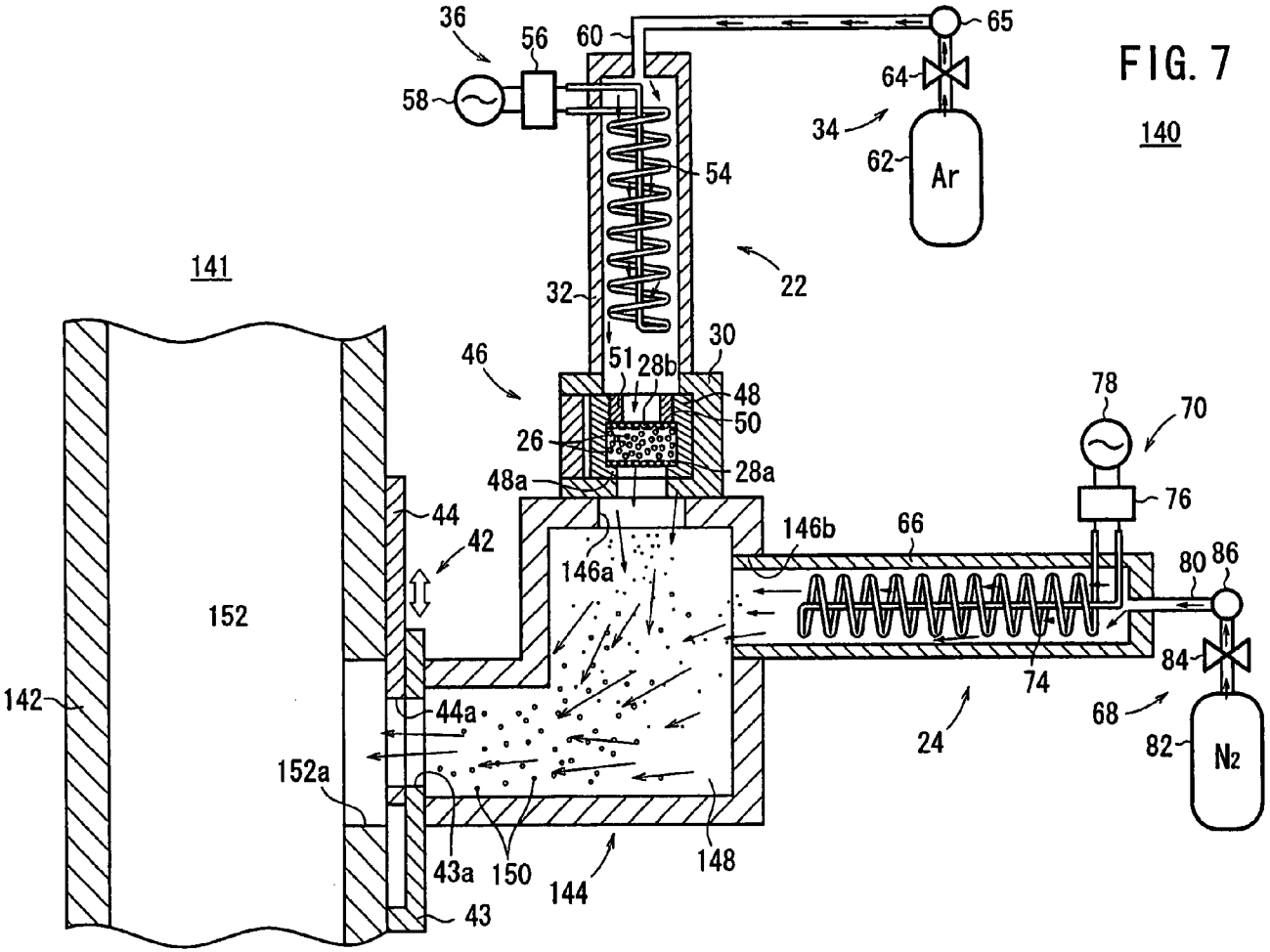
FIG. 7 is a cross-sectional view of a casting apparatus which incorporates a fine particle producing apparatus according to a fourth embodiment of the present invention.

FIG. 7 shows in cross section a casting apparatus 141 which incorporates a fine particle producing apparatus 140 according to a fourth embodiment of the present invention.

As shown in FIG. 7, the casting apparatus 141 comprises a casting mold 142 and a reaction unit 144 directly coupled to the mold 142. The fine particle producing apparatus 140 has a fine metal particle producing mechanism 22 and a high-temperature gas producing mechanism 24 which are mounted on the reaction unit 144.

The reaction unit 144 has a hole 146*a* defined in a side wall thereof and held in communication with the metal holder 30 of the fine metal particle producing mechanism 22, and a hole 146*b* defined in another side wall thereof and held in communication with the tube 66 of the high-temperature gas producing mechanism 24. The holes 146*a*, 146*b* are positioned relatively close to each other. The reaction unit 144 has a reaction chamber 148 in which a magnesium gas and/or fine particles of magnesium react with a nitrogen gas to produce fine particles of magnesium nitride.

The reaction unit 144 is detachably mounted on the mold 142 over a hole 152*a* defined therein with a molten metal check mechanism 42 interposed therebetween. The reaction unit 144 can communicate with a cavity 152 in the mold 142 through the hole 152*a*. The metal holder 30 may be integral with the reaction unit 144.

Operation of the casting apparatus 141 will be described below.

In the fine metal particle producing mechanism 22, while the interior of the tube 32 has been heated by the argon gas heating controller 36, an argon gas is supplied at a predetermined rate to the tube 32 through the argon gas flow rate controller 34. The magnesium powder 26 housed in the metal holder 30 reacts to produce a magnesium gas, which is turned into fine particles of magnesium that are introduced into the reaction chamber 148 in the reaction unit 144.

The high-temperature gas producing mechanism 24 operates as follows: The nitrogen gas heating controller 70 is first actuated to heat the interior of the tube 66 to a predetermined temperature, and then the nitrogen gas flow rate controller 68 is actuated. The nitrogen gas supplied from the nitrogen gas container 82 to the tube 66 at a controlled rate is heated to a predetermined temperature, and then introduced from the tube 66 into the reaction chamber 148.

In the reaction chamber 148, part of the magnesium gas coalesces into fine particles of magnesium, and the fine particles of magnesium and/or the magnesium gas which does not coalesce reacts with the high-temperature nitrogen gas ($3Mg+N_2 \rightarrow Mg_3N_2$), producing fine particles of magnesium nitride ($Mg_3N_2$). The fine particles of magnesium nitride produced in the reaction chamber 148 pass through the molten metal check mechanism 42, and are introduced directly into the cavity 152 in the mold 142 on which the reaction unit 144 is mounted.

After the molten metal check mechanism 42 is closed, molten aluminum (not shown), for example, is poured into the cavity 152. Since the fine particles of magnesium nitride have been present in the cavity 152, the fine particles of magnesium nitride are preferentially bonded to oxygen in the cavity 152, effectively preventing the molten aluminum from being oxidized in the cavity 152. As a consequence, the molten aluminum is kept well flowable in the cavity 152, and hence can well be cast to shape.

According to the fourth embodiment, the metal holder 30 of the fine metal particle producing mechanism 22 is directly mounted on the reaction unit 144, and the magnesium powder 26 held in the cartridge 46 is housed in the metal holder 30. The argon gas supplied at a rate controlled by the argon gas flow rate controller 34 has been introduced into the tube 32 which is kept at a predetermined temperature by the argon gas heating controller 36.

The magnesium powder 26 held by the metal holder 30 is thus heated by the argon gas supplied at the controlled rate and heated to the controlled temperature, reliably producing desired fine particles of magnesium (and a magnesium gas). Therefore, the fine particle producing apparatus 140 can effectively be reduced in size and simplified as it does not require a relatively large heating furnace. Furthermore, the reaction of the fine particles of magnesium (and the magnesium gas) can be controlled easily.

The high-temperature gas producing mechanism 24 is mounted on the reaction unit 144 for supplying the nitrogen gas, serving as a reactive gas, at the controlled rate and the controlled temperature, into the reaction chamber 148 in the reaction unit 144. Therefore, the magnesium gas and/or the fine particles of magnesium reacts well with the nitrogen gas in the reaction chamber 148, reliably producing desired fine particles 150 of magnesium nitride.

The fine particles 150 of magnesium nitride which are produced by the reaction unit 144 are introduced into the cavity 152 in the mold 142 where they are bonded to oxygen in the cavity 152. Accordingly, the molten aluminum poured into the cavity 152 is effectively prevented from being oxidized, and hence is kept well flowable in the cavity 40 and can well be cast to shape.

The reaction unit 144 is detachably mounted on the mold 142. The fine particle producing apparatus 140 is therefore is highly versatile as it can easily be applied to various molds other than the mold 142.

Figure 8:
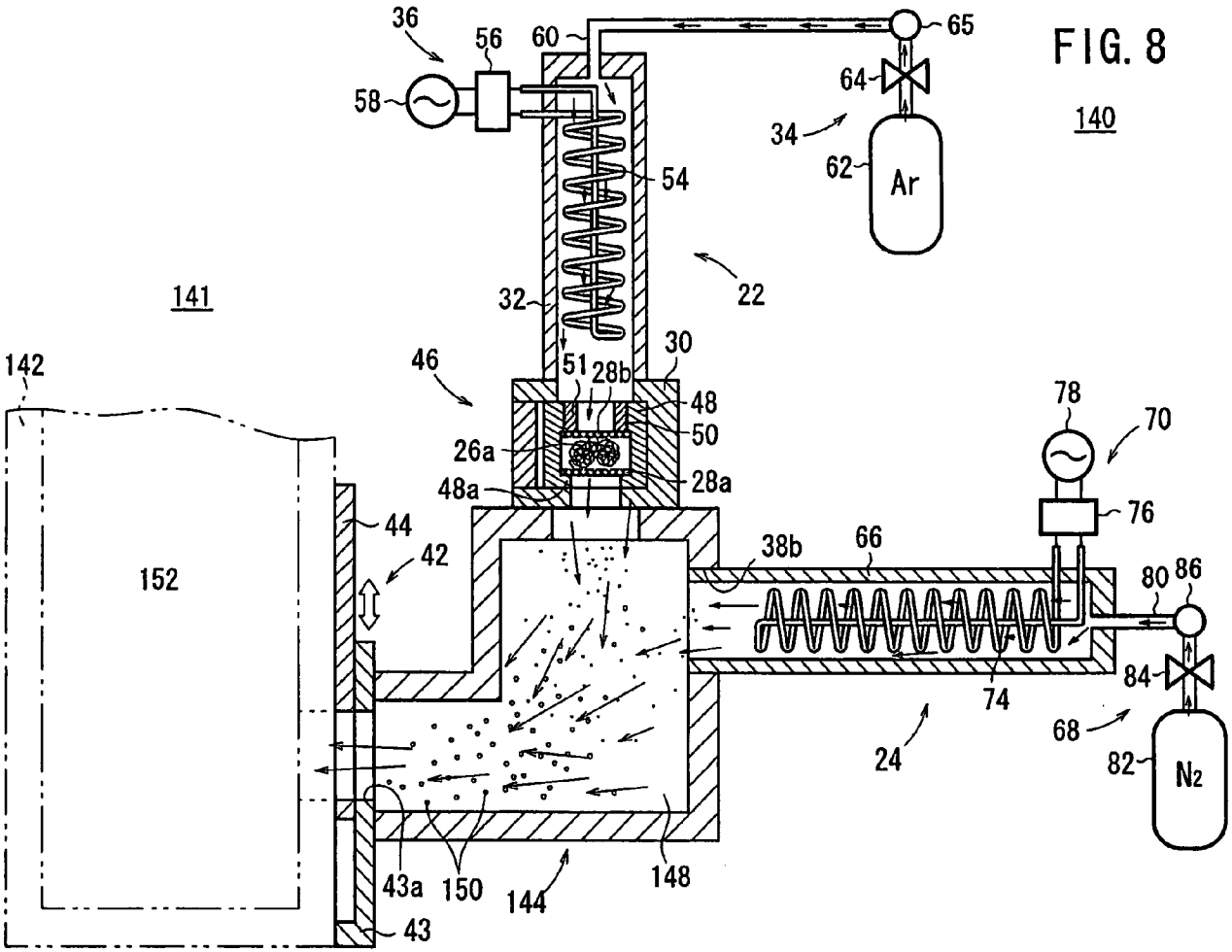
FIG. 8 is a cross-sectional view of the casting apparatus shown in FIG. 7 which is loaded with an elongate piece of magnesium.

In the fourth embodiment, the magnesium powder 26 is held in the cartridge 46 and removably housed in the metal holder 30. However, as shown in FIG. 8, an elongate piece 26*a* of magnesium such as a filamentary or web-shaped piece of magnesium may be held in the cartridge 46 and housed in the metal holder 30.

Figure 9:
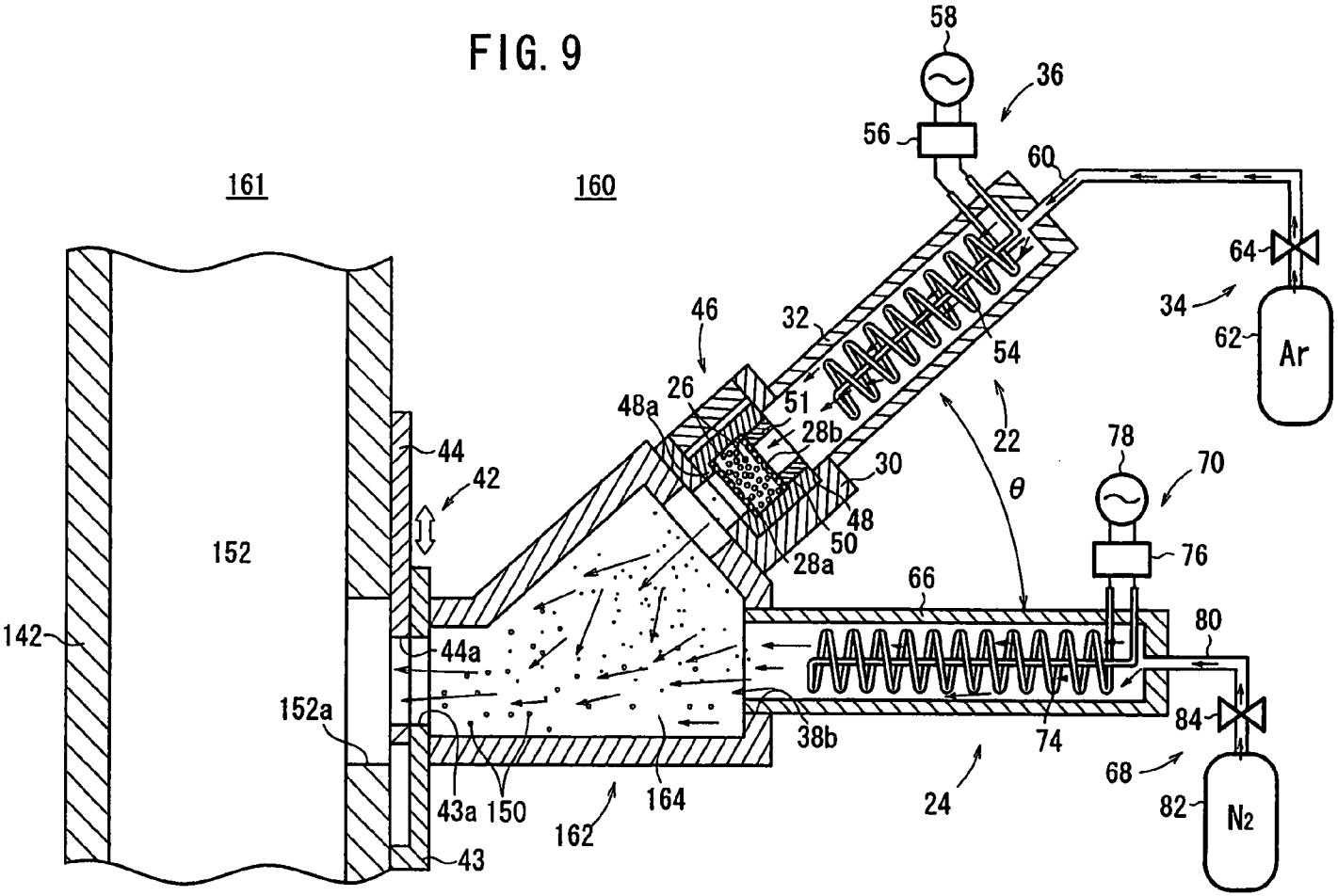
FIG. 9 is a cross-sectional view of a casting apparatus which incorporates a fine particle producing apparatus according to a fifth embodiment of the present invention.
Figure 10:
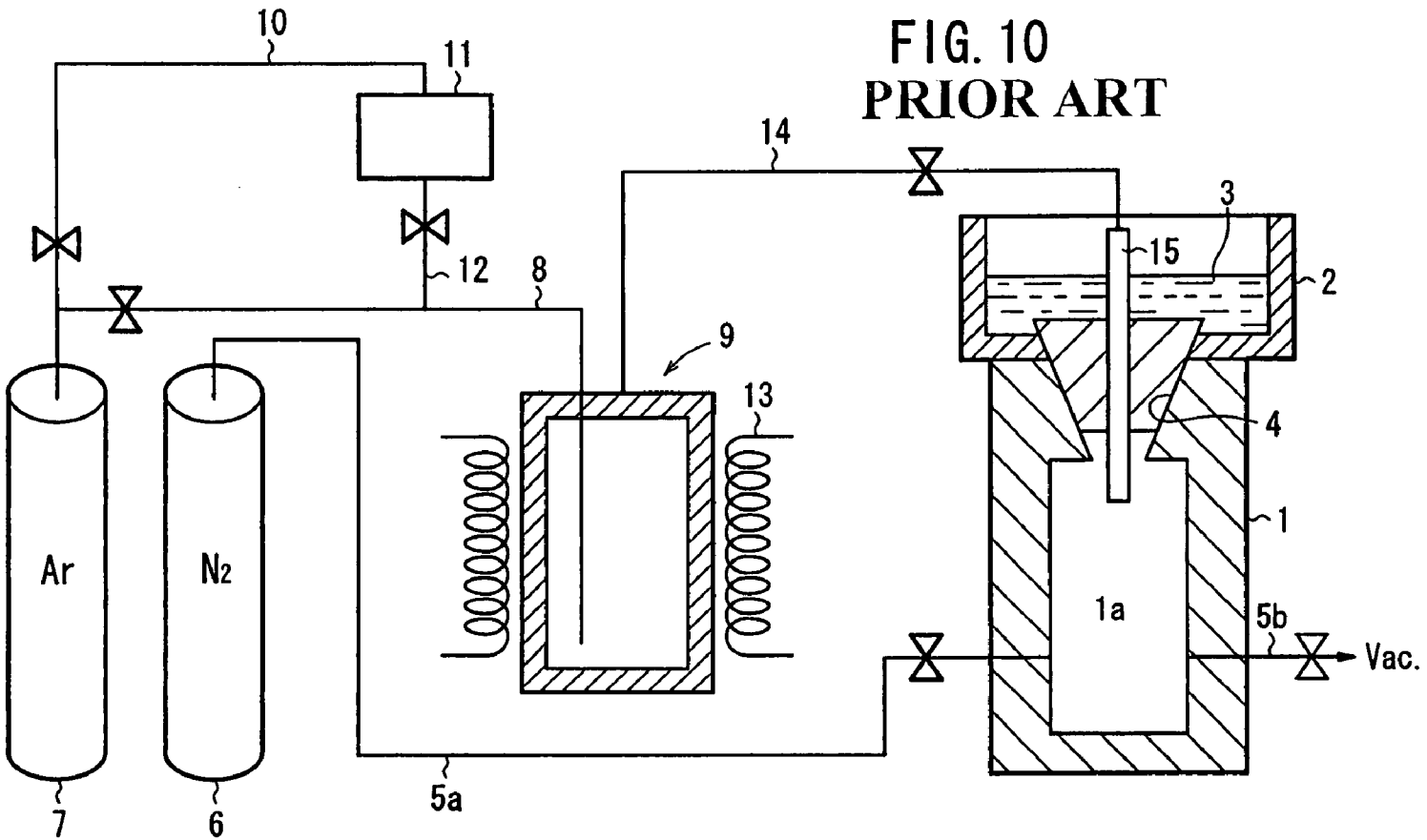
FIG. 10 PRIOR ART
FIG. 10 is a cross-sectional view of a conventional casting apparatus.
Figure 11:
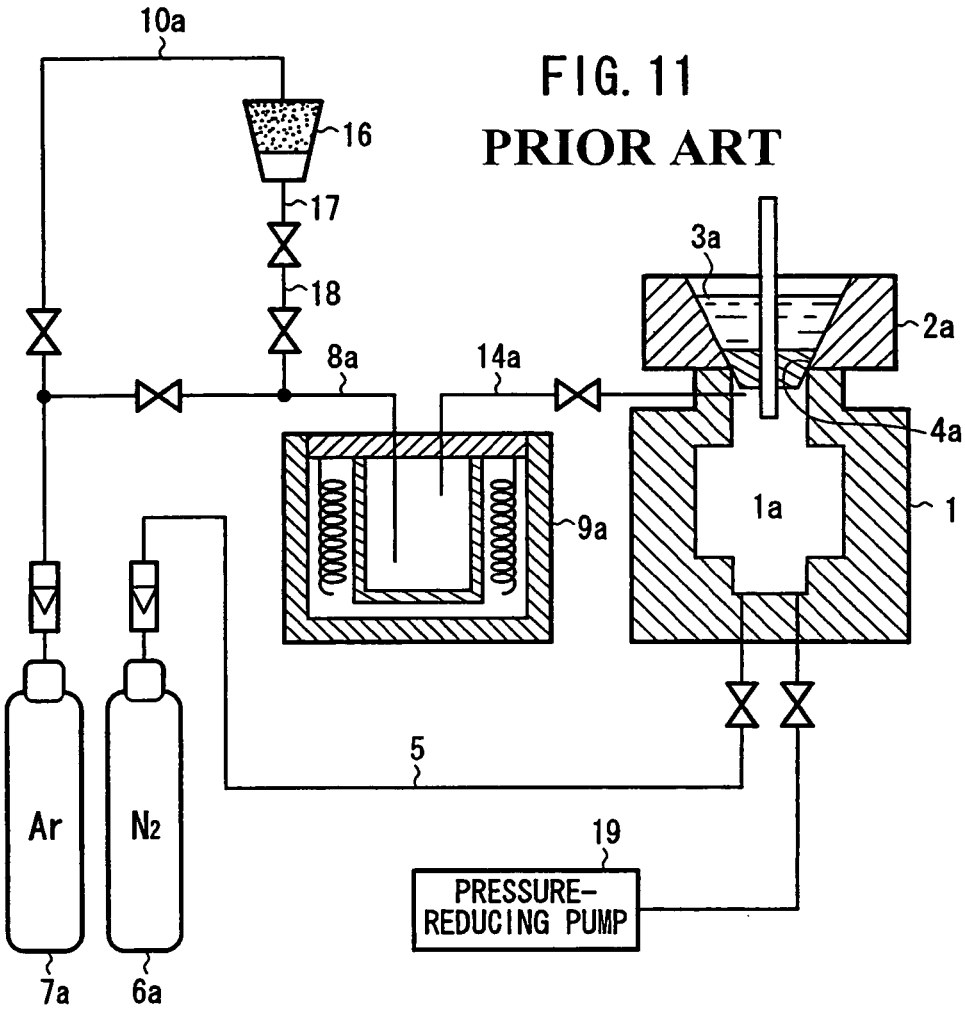
FIG. 11 PRIOR ART
FIG. 11 is a cross-sectional view of a conventional fine particle producing apparatus.

FIG. 9 shows in cross section a casting apparatus 161 which incorporates a fine particle producing apparatus 160 according to a fifth embodiment of the present invention. Those parts of the casting apparatus 161 which are identical to those of the casting apparatus 141 according to the fourth embodiment are denoted by identical reference characters, and will not be described in detail below.

The casting apparatus 161 has a reaction unit 162 directly coupled to the mold 142. The fine particle producing apparatus 160 has a fine metal particle producing mechanism 22 and a high-temperature gas producing mechanism 24 which are mounted on the reaction unit 162 such that their axes are inclined to each other by a predetermined angle θ° (θ°<90°).

The fine metal particle producing mechanism 22 and the high-temperature gas producing mechanism 24 thus inclined to each other introduce a magnesium gas and/or fine particles of magnesium and a nitrogen gas, respectively, into a reaction chamber 164 in the reaction unit 162 in respective directions which are inclined to each other by the angle θ°. The magnesium gas and/or the fine particles of magnesium and the nitrogen gas thus introduced react well with each other in the reaction chamber 164, generating desired fine particles 150 of magnesium nitride easily and reliably.

In the first through fifth embodiments, the argon gas is used as the inactive gas, and the nitrogen gas is used as the reactive gas. However, any of various other inactive and reactive gases may be used.

According to the present invention, inasmuch as the metal held by the metal holder is heated by the gas controlled at the predetermined rate and the predetermined temperature, the fine particle producing apparatus can produce desired fine metal particles reliably. The fine particle producing apparatus in its entirety can effectively be reduced in size and simplified as it does not require a relatively large heating furnace. The fine particle producing apparatus is highly versatile because it can be detachably mounted on various molds.

According to the present invention, the magnesium held by the metal holder is heated by the inactive gas controlled at the predetermined rate and the predetermined temperature, and then supplied to the reaction unit. The reaction unit is also supplied with the nitrogen gas heated to the predetermined temperature.

Consequently, the reaction unit is capable of producing desired fine particles of magnesium nitride reliably. The reaction unit in its entirety can effectively be reduced in size and simplified as it does not require a relatively large heating furnace. The reaction unit is highly versatile because it can be detachably mounted on various molds.

According to the present invention, the mold cavity is supplied with fine metal particles immediately after they are produced and a reactive gas, and produces an active substance which is easily oxidizable. The active substance thus produced is preferentially bonded to oxygen in the mold cavity, effectively preventing a molten metal poured into the mold cavity from being oxidized in the mold cavity. As a consequence, the molten metal is kept well flowable in the mold cavity, and hence can well be cast smoothly to shape.

Since the fine particle producing mechanism is directly coupled to the mold, no pipe for supplying fine metal particles is required, and no conventional large heating furnace is needed. Therefore, the overall casting apparatus can easily be reduced in size and simplified, and the amount of heat required to cause the reaction is reduced. As the fine metal particle producing mechanism and the high-temperature gas producing mechanism are detachably mounted on the mold, the number of replacing steps required to replace the mold can effectively be reduced for efficient replacing operation.

The reaction unit is directly coupled to the mold. The reaction unit is supplied with fine metal particles immediately after they are produced and a reactive gas, and produces an active substance. The active substance thus produced is directly introduced into the mold cavity. Since the active substance is reliably supplied into the mold cavity, it is possible to prevent the surface of the molten metal poured into the mold cavity from being oxidized in the mold cavity.

Immediately after the active substance which is more active with respect to oxygen than the molten metal is produced, the active substance is directly introduced into the mold cavity. Consequently, the surface of the molten metal poured into the mold cavity is efficiently prevented from being oxidized in the mold cavity, and the casting apparatus can be reduced in size.

According to the present invention, furthermore, the heated gas is supplied to the metal which is more active with respect to oxygen than the molten metal to produce a feed material containing at least a metal gas or fine metal particles, after which the feed material is introduced into the mold cavity. In the mold cavity, therefore, the feed material is bonded to oxygen, providing a low-oxygen environment in the mold cavity, and no seal is required to seal the mold cavity hermetically.

When the molten metal is poured into the mold cavity, even if oxygen flows with the molten metal into the mold cavity, the floating fine metal particles in the molding cavity are bonded to the oxygen, effectively preventing the molten metal from being oxidized. The molten metal is thus kept well flowable in the mold cavity, and hence can well be cast smoothly to shape.

The feed material introduced into the mold cavity is deposited as a porous layer on the inner wall surface of the mold cavity, and the porous layer has a heat insulating ability. No special heat insulating material needs to be applied as a heat insulation coating to the inner wall surface of the mold cavity.

The invention claimed is:

1. A casting apparatus comprising:

a mold for supplying a molten metal into a cavity to produce a casting;

a fine particle producing mechanism for producing fine metal particles active with respect to oxygen;

a reactive gas supply mechanism for supplying a reactive gas for reacting with said fine metal particles to produce an active substance which is more active with respect to oxygen than said molten metal; and a reaction unit for deoxidation directly mounted on and connected to said mold for causing a reaction between said fine metal particles and said reactive gas to produce said active substance and immediately thereafter introducing said active substance directly into said cavity, said fine particle producing mechanism and said reactive gas supply mechanism being directly mounted on said reaction unit.

2. A casting apparatus according to claim 1, wherein said molten metal comprises molten aluminum, said fine metal particles comprise fine particles of magnesium, said reactive gas comprises a nitrogen gas, and said active substance comprises magnesium nitride.

3. A casting apparatus according to claim 1, wherein the fine particle producing mechanism includes:

a tube directly mounted on said reaction unit with a heating unit operatively mounted therein, and a holder for positioning Mg powder and a supply of argon gas that is heated by said heating unit and then brought into communication with the Mg powder for forming a Mg gas that is directly supplied to said reaction unit.

4. The casting apparatus according to claim 3, wherein said reactive gas supply mechanism includes a tube directly mounted on said reaction unit with a heating unit operatively mounted therein and a supply of Nitrogen gas that is heated by said heating unit and then brought into communication with the Mg gas for forming $Mg_3N_2$ for directly being supplied to said cavity.

5. A casting apparatus comprising:

a mold for supplying a molten metal into a cavity to produce a casting; and an active substance producing mechanism for deoxidation directly mounted on said mold for producing an active substance which is more active with respect to oxygen than said molten metal and immediately thereafter introducing said active substance directly into said cavity, wherein said active substance producing mechanism applies a heated argon gas to solid metal to produce at least a metal gas or fine metal particles produced by coalescence of said metal gas and to introduce at least said metal gas or said fine metal particles into said cavity by an argon gas, said metal gas or said fine metal particles being more active with respect to oxygen than said molten metal.

6. A casting apparatus according to claim 5, wherein said molten metal comprises molten aluminum, and said active substance comprises at least either one of magnesium nitride and fine particles of magnesium.

7. The casting apparatus according to claim 5, and further including a fine particle producing mechanism directly mounted on said active substance producing mechanism, said fine particle producing mechanism includes a tube with a heating unit operatively mounted therein, a holder for positioning Mg powder and a supply of argon gas that is heated by said heating unit and then brought into communication with the Mg powder for forming a Mg gas that is directly supplied to said active substance producing mechanism.

8. The casting apparatus according to claim 7, and further including a reactive gas supply mechanism directly mounted on said active substance producing mechanism, said reactive gas supply mechanism includes a tube with a heating unit operatively mounted therein and a supply of Nitrogen gas that is heated by said heating unit and then brought into communication with the Mg gas for forming $Mg_3N_2$ in said cavity.

9. A method of pouring a molten metal into a cavity in a mold to produce a casting, comprising the steps of:

directly mounting an active substance producing mechanism to said cavity, said active substance producing mechanism including a holder for positioning a metal;

supplying a heated argon gas to said metal which is more active with respect to oxygen than said molten metal, thereby to produce a feed material active with respect to oxygen and containing at least a metal gas or fine metal particles produced by coalescence of said metal gas;

supplying said feed material directly to said cavity to cause said feed material to be oxidized to develop a low-oxygen environment in said cavity, and causing at least said metal gas or said fine metal particles active with respect to oxygen to float in said cavity and be deposited on an inner wall surface of said cavity for deoxidation; and pouring said molten metal into said cavity.

10. A casting apparatus comprising:

a mold for supplying a molten metal into a cavity to produce a casting;

a fine particle producing mechanism directly mounted on said mold for producing fine metal particles active with respect to oxygen;

a reactive gas supply mechanism directly mounted on said mold for supplying a reactive gas for reacting with said fine metal particles to produce an active substance which is more active with respect to oxygen than said molten metal; and said mold cavity forming a reaction unit for deoxidation for causing a reaction between said fine metal particles and said reactive gas to produce said active substance in said mold cavity.

11. The casting apparatus according to claim 10, wherein the fine particle producing mechanism includes a tube directly mounted on said mold with a heating unit operatively mounted therein, a holder for positioning Mg powder and a supply of argon gas that is heated by said heating unit and then brought into communication with the Mg powder for forming a Mg gas that is directly supplied to said cavity.

12. The casting apparatus according to claim 11, wherein said reactive gas supply mechanism includes a tube directly mounted on said mold with a heating unit operatively mounted therein and a supply of Nitrogen gas that is heated by said heating unit and then brought into communication with the Mg gas in said cavity for forming $Mg_3N_2$.

13. The casting apparatus according to claim 10, wherein said molten metal comprises molten aluminum, said fine metal particles comprise fine particles of magnesium, said reactive gas comprises a nitrogen gas, and said active substance comprises magnesium nitride.

* * * * *

UNITED STATES PATENT AND TRADEMARK OFFICE

CERTIFICATE OF CORRECTION

PATENT NO. : 7,448,427 B2
APPLICATION NO. : 11/589190
DATED : November 11, 2008
INVENTOR(S) : Hiroshi Ishii et al.

It is certified that error appears in the above-identified patent and that said Letters Patent is hereby corrected as shown below:

On the Cover page:

Item (30) Foreign Application Priority Data, insert the following Foreign Application Priority Data information:

-- (30) Foreign Application Priority Data

March 13, 2002 (JP)---------- 2002-068069

March 13, 2002 (JP)---------- 2002-068769

March 13, 2002 (JP)---------- 2002-068777

March 13, 2002 (JP)---------- 2002-068797 --

Signed and Sealed this

Fourteenth Day of April, 2009

John Doll

JOHN DOLL
*Acting Director of the United States Patent and Trademark Office*